US005893350A

United States Patent [19]

Timms

[11] Patent Number: 5,893,350

[45] Date of Patent: Apr. 13, 1999

[54] INJECTOR

[75] Inventor: Colin Thomas Timms, Middlesex, United Kingdom

[73] Assignee: Lucas Industries plc, United Kingdom

[21] Appl. No.: 08/905,443

[22] Filed: Aug. 4, 1997

[30] Foreign Application Priority Data

Aug. 6, 1996 [GB] United Kingdom ..... 9616521

[51] Int. Cl.[6] ..... F02M 41/00

[52] U.S. Cl. ..... 123/467; 239/96; 123/506; 137/601

[58] Field of Search ..... 123/446, 447, 123/467, 506; 239/88–96, 585.1; 137/601

[56] References Cited

U.S. PATENT DOCUMENTS 5,441,029 8/1995 Hlousek ..... 123/467
5,526,791 6/1996 Timmer et al. ..... 123/467
5,626,119 5/1997 Timms ..... 123/467
5,664,545 9/1997 Kato et al. ..... 123/467

*Primary Examiner*—Thomas N. Moulis
*Attorney, Agent, or Firm*—Andrus, Sceales, Starke & Sawall

[57] ABSTRACT

An injector is disclosed which comprises a nozzle body arranged to receive fuel under pressure from a pumping chamber. An injection control arrangement in the form of a valve controls injection timing, and a drain control arrangement in the form of a valve controls communication between the pumping chamber and a fuel reservoir. An electromagnetic actuator controls operation of both valves, the actuator including a single, common armature which is associated with both of the valves.

13 Claims, 2 Drawing Sheets

INJECTOR

This invention relates to an injector for use in supplying fuel to a cylinder of an internal combustion engine. In particular, the invention relates to an injector capable of being operated so that the fuel pressure at the time of injection is controllable independently of the timing of injection.

An injector capable of being operated as set out above comprises a drain valve operable to control communication between a suitable low pressure reservoir and a supply line for supplying fuel at high pressure to an injection nozzle, and a control valve arranged to permit control of the movement of a valve needle provided in the injection nozzle. The timing of injection is controlled by the control valve, the injection pressure being determined by the timing of operation of the drain valve with respect to the timing of operation of the control valve. Electromagnetic actuators are provided for controlling operation of the drain and control valves. The electromagnetic actuators may comprise individual armatures associated with the drain and control valves, the armatures being moveable under the influence of a single stator arrangement.

It is an object of the invention to provide an injector of the type described hereinbefore of relatively simple construction.

In accordance with the invention there is provided an injector for injecting fuel into a combustion chamber of an engine during an injection sequence comprising:

pump means including a pumping chamber;

an nozzle body having an outlet orifice;

a fuel line interconnecting the pumping chamber and the nozzle body;

drain control means controlling communication between the pumping chamber and a fuel reservoir;

injection control means for controlling the injection of pressurized fuel through the orifice to the engine combustion chamber; and an electromagnetic actuator including a common armature for controlling the operation of the injection control means and the drain control means.

The provision of a single, common electromagnetic actuator including a single, common armature reduces the complexity of the injector, the electrical connections to the controller only requiring the connection of one electromagnetic actuator.

The injector conveniently comprises a pump/injector, the pump means forming part of the injector.

Figure 1:
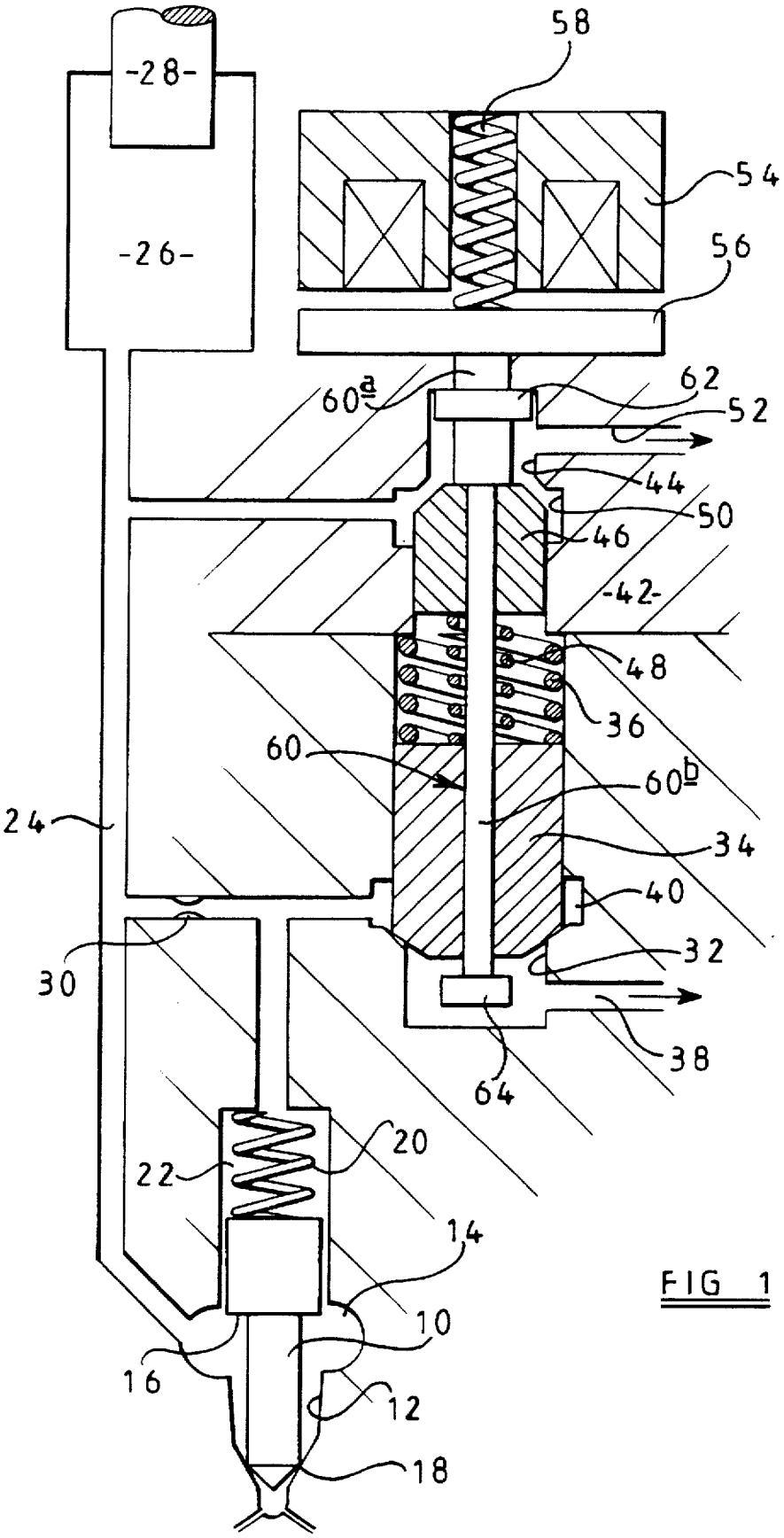
Figure 2:
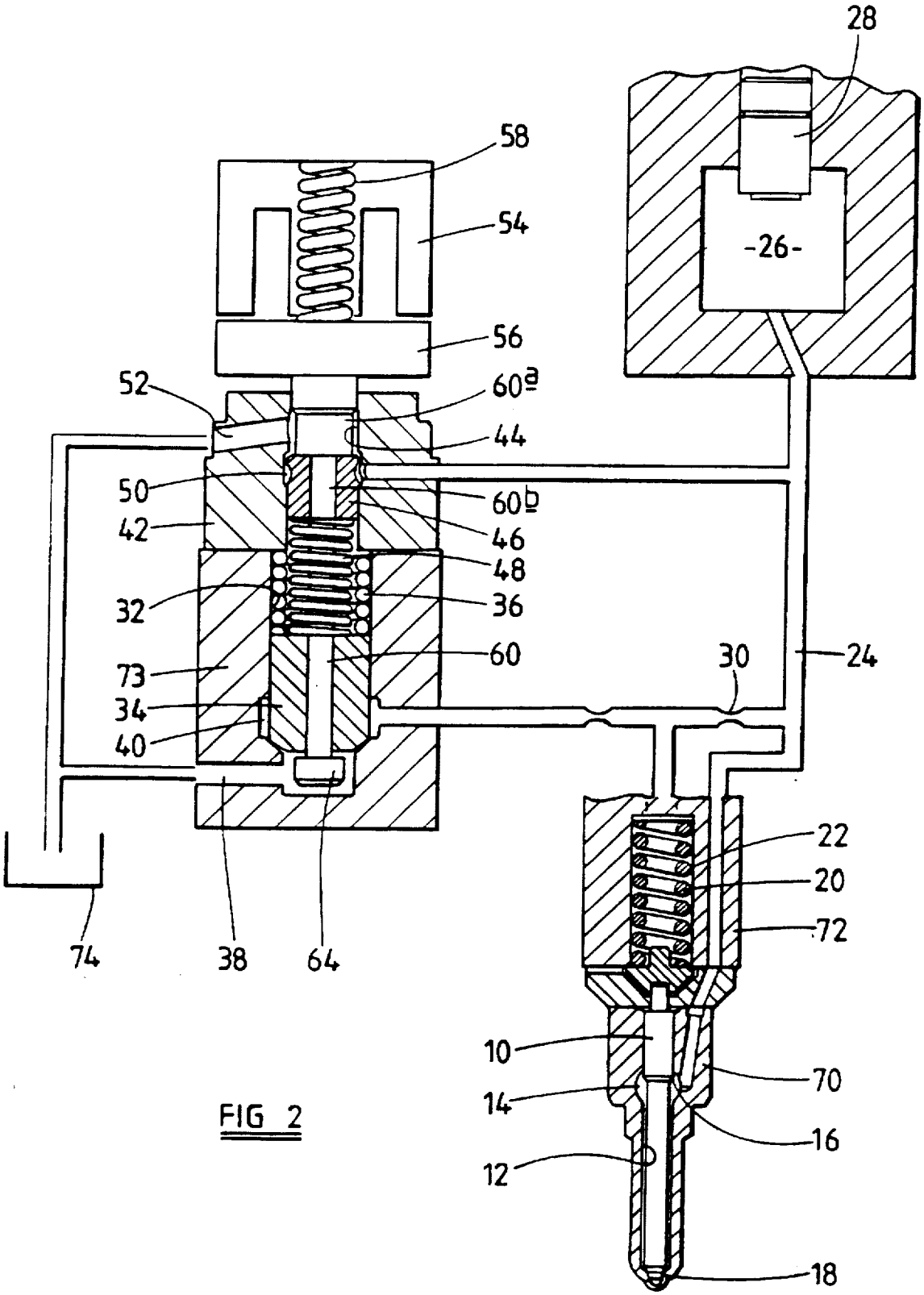

The invention will further be described, by way of example, with reference to the accompanying drawings, in which:

FIG. 1 is a sectional diagrammatic view of an injector constituting an embodiment of the invention; and FIG. 2 is a sectional diagrammatic view of an injector similar to that illustrated in FIG. 1.

The injectors illustrated in the accompanying drawings are very similar to one another and apart from where indicated, the description hereinafter is applicable to both injectors. In the drawings, like reference numerals are used to denote like parts.

The injectors illustrated in the accompanying drawings each comprise a valve needle 10 which is slidable within a bore 12 formed in a nozzle body 70 (see FIG. 2). The bore 12 includes an annular chamber 14, the part of the needle 10 received within the annular chamber 14 including a thrust surface 16 arranged such that the application of high pressure fuel to the chamber 14 tends to lift the valve needle 10 away from a seating 18, the needle 10 being biased into engagement with the seating 18 by means of a spring 20 which is located in a spring chamber 22. As illustrated in FIG. 2, the spring chamber 22 may be defined, in part, by a bore provided in a spring housing 72. An end region of the needle 10 extends into the chamber 22. The chamber 14 communicates through a supply passage 24 with a pump chamber 26 within which a pumping plunger 28 is reciprocable. The pumping plunger 28 is conveniently arranged to be moved under the action of a cam and tappet arrangement (not shown) to compress the fuel within the pumping chamber 26, outward movement of the pumping plunger 28 conveniently occurring under the action of a spring (not shown). The supply passage 24 communicates through a restrictor 30 with the chamber 22.

A valve arrangement is provided in order to control the operation of the injector, the valve arrangement comprising a bore 32 provided in a control valve housing 73 (see FIG. 2) within which a control valve member 34 is slidable, a spring 36 being arranged to bias the valve member 34 into engagement with a seating defined by part of the bore 32. The control valve member 34 is of relatively large diameter, and the spring 36 is engaged between the control valve member 34 and a step defined between the control valve housing 73 and a drain valve housing (described hereinafter). Downstream of the seating, the bore 32 communicates through a passage 38 with a suitable low pressure drain 74 (see FIG. 2). Upstream of the seating, the bore 32 defines an annular chamber 40 which communicates with the chamber 22. It will be appreciated, therefore, that the position of the control valve member 34 determines whether or not the chamber 22 communicates with the low pressure drain.

A drain valve housing 42 is mounted upon the control valve housing 73, a bore 44 being provided in the drain valve housing 42, the bore 44 being coaxial with the bore 32. A drain valve member 46 is slidable within the bore 44, the drain valve member 46 being biased towards a seating defined by part of the bore 44 by means of a spring 48 engaged between the drain valve member 46 and the control valve member 34. Upstream of the seating, the bore 44 and drain valve member 46 define an annular chamber 50 which communicates with the passage 24, the part of the bore 44 downstream of the seating communicating through a passage 52 with the low pressure drain 74.

In order to control the positions of the drain and control valve members 34, 46, an electromagnetic actuator is provided. The electromagnetic actuator comprises a stator 54 provided with a winding, and an armature 56 which is moveable under the influence of the magnetic field generated by applying an electrical current to the winding. A helical spring 58 is provided to bias the armature 56 away from the stator 54.

The armature 56 is located coaxially with the bores 32, 44, the armature 56 being provided with a rod 60 which extends into the bore 44, the rod 60 sealingly engaging the bore 44 downstream of the connection of the bore 44 and passage 52 to substantially prevent leakage of fuel from the bore 44. The rod 60 is a piston-like sliding fit within an axially extending bore provided in the drain valve member 46, and similarly is a sliding fit within an axially extending bore provided in the control valve member 34. The rod 60 includes a region **60*a* of relatively large diameter and a region 60*b* of relatively small diameter, a shoulder defining the connection of the parts 60*a* and 60*b*. The drain valve member 46 is biased into engagement with the shoulder by means of the spring 48. The lowermost part of the rod 60 includes an outwardly extending flange 64, and in use, as described hereinafter, the flange 64 is engageable with the lowermost part of the control valve member 34**.

In use, starting from the position illustrated in the accompanying drawings, the winding is not energised thus the armature 56 is biased by means of the spring 58 away from the stator 54 and the engagement of the drain valve member 46 with the shoulder of the rod 60 results in the drain valve member 46 occupying a position in which it is spaced from its seating. The pump chamber 26 therefore communicates with the low pressure drain. The position of the rod 60 is such that the flange 64 is spaced from the lower end of the control valve member 34, and the control valve member 34 is biased into engagement with its seating by the spring 36. The chamber 22 therefore does not communicate with the low pressure drain and the fuel pressure within the chamber 22 is substantially equal to that within the pumping chamber 26. Similarly, the pressure applied to the annular chamber 14 is substantially equal to the pressure within the pumping chamber 26, and as the area of the thrust surface 16 is smaller than the effective area of the part of the needle 10 exposed to the fuel pressure within the chamber 22, the effect of the fuel pressure on the needle 10 together with the effect of the spring 20 results in the needle 10 occupying a position in which it is in engagement with the seating 18. The pumping plunger 28 is being pushed outwardly under the action of the spring (not shown) thus increasing the volume of the pumping chamber 26 and drawing fuel into the pumping chamber 26 through the passage 52 past the drain valve member 46.

Subsequently, the plunger 28 will commence inward movement under the action of the cam arrangement. The inward movement of the pumping plunger 28 results in fuel from the pumping chamber 26 being displaced back past the drain valve member 46 to the passage 52 and from there to the low pressure drain. When it is desired to commence pressurizing the fuel within the chamber 26, a current is applied to the winding to generate a magnetic field resulting in movement of the armature 56 against the action of the spring 58 to a sufficient extent to permit the drain valve member 46 to move into engagement with its seating under the action of the spring 48. The current is subsequently allowed to fall to a first holding current level sufficient to maintain the armature in this position. The movement of the armature 56 may be sufficient to bring the flange 64 into engagement with the lower surface of the control valve member 34 but is insufficient to lift the control valve member 34 away from its seating against the action of the spring 36 which, conveniently, is relatively highly preloaded. The movement of the armature 56 is therefore sufficient to break the communication between the pumping chamber 26 and the low pressure drain, but is insufficient to cause the chamber 22 to communicate with the low pressure drain.

As the pumping chamber 26 no longer communicates with the low pressure drain, further inward movement of the pumping plunger 28 results in the pressure within the pumping chamber 26 increasing. As the pressure applied to the chamber 22 is substantially equal to that applied to the chamber 14, the needle 10 remains in contact with its seating as described hereinbefore thus injection does not commence.

When injection is to commence, the winding is fully energised to lift the armature 56 against the action of the springs 36, 48, 58 by a further amount, the engagement of the flange 64 with the lower end of the control valve member 34 resulting in the control valve member 34 being lifted from its seating thus permitting communication between the chamber 22 and the low pressure drain. The current is subsequently allowed to fall to a second holding current level sufficient to maintain the armature in this position. As the chamber 22 now communicates with the low pressure drain, the pressure applied to the part of the valve needle 10 exposed to the pressure within the chamber 22 is insufficient to maintain the needle 10 in engagement with its seating thus the needle 10 is moved against the action of the spring 20 and fuel is supplied from the pumping chamber 26 past the seating 18 to be injected through outlet orifices provided in the end of the nozzle body. It will be appreciated that the provision of the restrictor 30 restricts the flow of fuel to the chamber 22 thus as the chamber 22 communicates with the low pressure drain, the flow of fuel to the chamber 22 is insufficient to raise the pressure therein to a level great enough to result in movement of the needle 10 into engagement with its seating.

In order to terminate the injection, the current applied to the winding is reduced thus the armature 56 moves under the action of the springs 36, 48, 58 away from the stator 54 to an extent sufficient to permit the control valve member 34 to move into engagement with its seating. Such movement of the control valve member 34 breaks the communication between the chamber 22 and low pressure drain thus the restricted flow of fuel to the chamber 22 results in the pressure therein increasing to an extent sufficient to assist the spring 20 in returning the needle 10 into engagement with its seating. Injection is then terminated.

If another injection is required while the plunger 28 continues to move inwards, for example where a pilot injection is to be followed by a main injection, the winding is fully energised once more to lift the control valve member 34 away from its seating thus commencing injection again as described hereinbefore. Such injection is terminated in the same manner as described hereinbefore.

After injection has been terminated, the winding is fully de-energised and the armature 56 moves under the action of the spring 58 to the position shown. Such movement of the armature 56 results in the drain valve member 46 being lifted from its seating thus permitting fuel to flow from the pumping chamber 26 to the low pressure drain. The pressure in the pumping chamber 26 is therefore relieved. Continued inward movement of the pumping plunger 28 results in further fuel from the pumping chamber 26 being displaced past the drain valve member 46 to the low pressure drain. Subsequently the pumping plunger 28 will commence outward movement under the action of the spring and filling of the pumping chamber 26 will occur as described hereinbefore ready for another pumping cycle to commence.

It will be appreciated that the presence of the separate drain and control valve arrangements permits the pressure of fuel within the pumping chamber 26 at the commencement of injection to be controlled independently of the timing of injection, the pressure within the pumping chamber 26 being dependent upon the timing at which the drain valve member 46 closes with respect to the timing at which the control valve member 34 is lifted from its seating to commence injection. As control of both of the valve members is achieved using a single electromagnetic actuator including a single, common armature 56, it will be appreciated that the only electrical connections required to control operation of the injector are the connections of the winding. Manufacture and installation of the injector are therefore relatively simple.

I claim:

1. An injector for injecting fuel into a combustion chamber of an engine during an injection sequence comprising:

pump means including a pumping chamber;

a nozzle body having an outlet orifice;

a fuel line interconnecting the pumping chamber and the nozzle body;

drain control means controlling communication between the pumping chamber and a fuel reservoir;

injection control means for controlling the injection of pressurized fuel through the orifice to the engine combustion chamber, the drain control means and the injection control means being separate and distinct from each other; and an electromagnetic actuator including a common armature for controlling the operation of the injection control means and the drain control means.

2. An injector as claimed in claim 1, wherein the injection control means and drain control means are arranged such that when the armature occupies a first position, the drain control means permits communication between the pumping chamber and the reservoir, the injection control means preventing injection of fuel through the orifice, when the armature occupies a second, intermediate position, the drain control means breaks communication between the pumping chamber and the reservoir, the injection control means continuing to prevent injection, and when the armature occupies a third position, the injection control means permits injection of fuel through the orifice.

3. An injector as claimed in claim 1, wherein the drain control means comprises a drain control valve.

4. An injector as claimed in claim 3, wherein the injection control means comprises an injection control valve.

5. An injector as claimed in claim 4, wherein the nozzle body includes a bore within which a valve needle is slidable, the needle being biased into engagement with a seating, the needle having a surface associated therewith exposed to the pressure of fuel within a control chamber, the surface being orientated such that the application of fuel under pressure to the control chamber applies a force to the needle urging the needle into engagement with its seating, wherein the injection control valve controls the fuel pressure within the control chamber.

6. An injector as claimed in claim 5, wherein the control chamber communicates with the pumping chamber through a restrictor, the injection control valve controlling communication between the control chamber and a low pressure drain.

7. An injector as claimed in claim 5, wherein the injection control valve and drain control valve are arranged such that when the armature occupies a first position, the drain control valve permits communication between the pumping chamber and the reservoir, the injection control valve controlling the pressure within the control chamber to be substantially equal to that in pumping chamber, when the armature occupies a second, intermediate position, the drain control valve breaks communication between the pumping chamber and the reservoir, the pressure within the control chamber remaining at substantially the same pressure as that within the pumping chamber under the control of the injection control valve, and when the armature occupies a third position, the injection control valve allows the fuel pressure within the control chamber to fall to a low level.

8. An injector as claimed in claim 7, wherein the armature occupies its first position when substantially zero current is applied to the electromagnetic actuator, the armature being held in the second position against the action of a first spring loading by the application to the actuator of a first low magnitude holding current, and being held in the third position against the action of a second spring loading by the application of a second, higher holding current to the actuator.

9. An injector as claimed in claim 7, wherein when the armature occupies its first position, the drain control valve is open and the injection control valve is closed, movement of the armature to its second position closing the drain control valve whilst the injection control valve remains closed and movement of the armature to its third position opening the injection control valve whilst the drain control valve remains closed.

10. An injector for injecting fuel into a combustion chamber of an engine during an injection sequence comprising:

pump means including a pumping chamber;

a nozzle body having an outlet orifice;

a fuel line interconnecting the pumping chamber and the nozzle body;

drain control means controlling communication between the pumping chamber and a fuel reservoir;

injection control means for controlling the injection of pressurized fuel through the orifice to the engine combustion chamber; and an electromagnetic actuator for controlling the operation of the injection control means and the drain control means, wherein whilst a first, relatively low holding current is applied to the actuator, the drain control means breaks communication between the pumping chamber and the fuel reservoir, and whilst a second, higher holding current is applied to the actuator, the injection control means permits injection of fuel.

11. An injector as claimed in claim 10, wherein the drain control means comprises a drain control valve.

12. An injector as claimed in claim 11, wherein the nozzle body includes a bore within which a valve needle is slidable, the needle being biased into engagement with a seating, the needle having a surface associated therewith exposed to the pressure of fuel within a control chamber, the surface being oriented such that the application of fuel under pressure to the control chamber applies a force to the needle urging the needle into engagement with its seating, wherein the injection control means comprises an injection control valve controlling the fuel pressure within the control chamber.

13. An injector as claimed in claim 12, wherein the actuator includes an armature, the injection control valve and drain control valve being arranged such that when substantially no current is applied to the actuator, the armature of the actuator occupies a rest position in which the drain control valve permits communication between the pumping chamber and the reservoir, the injection control valve controlling the pressure within the control chamber to be substantially equal to that in pumping chamber, when the first current is applied to the actuator, the armature occupies a first, intermediate position in which the drain control valve breaks communication between the pumping chamber and the reservoir, the pressure within the control chamber remaining at substantially the same pressure as that within the pumping chamber under the control of the injection control valve, and when the second current is applied to the actuator, the armature occupies a second position in which the injection control valve allows the fuel pressure within the control chamber to fall to a low level.

* * * * *